US011787207B2

(12) United States Patent
Yasuki et al.

(10) Patent No.: US 11,787,207 B2
(45) Date of Patent: Oct. 17, 2023

(54) OPENING/CLOSING MECHANISM FOR OPENING/CLOSING COVER AND TAPE PRINTING DEVICE

(71) Applicant: SEIKO EPSON CORPORATION, Tokyo (JP)

(72) Inventors: Hirosuke Yasuki, Matsumoto (JP); Kenji Motai, Matsumoto (JP); Keisuke Taruya, Shiojiri (JP); Keishin Sakamoto, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/696,176

(22) Filed: Mar. 16, 2022

(65) Prior Publication Data

US 2022/0297453 A1 Sep. 22, 2022

(30) Foreign Application Priority Data

Mar. 17, 2021 (JP) ..... 2021-043201

(51) Int. Cl.
*B41J 15/04* (2006.01)
*B41J 35/28* (2006.01)
*B41J 3/407* (2006.01)

(52) U.S. Cl.
CPC ..... *B41J 15/044* (2013.01); *B41J 3/4075* (2013.01); *B41J 35/28* (2013.01)

(58) Field of Classification Search
CPC ..... B41J 15/044; B41J 3/4075; B41J 35/28
See application file for complete search history.

(56) References Cited

U.S. PATENT DOCUMENTS

| | | | | |
|---|---|---|---|---|
| 5,921,688 | A | 7/1999 | Furuya et al. | |
| 2001/0016135 | A1* | 8/2001 | Hosomi | B41J 15/042 400/613 |
| 2016/0039219 | A1* | 2/2016 | Kosuge | B41J 3/4075 347/214 |
| 2016/0167388 | A1 | 6/2016 | Kosuge | |
| 2017/0267000 | A1* | 9/2017 | Takahashi | B41J 29/02 |
| 2020/0369051 | A1* | 11/2020 | Yasuki | B41J 11/666 |

FOREIGN PATENT DOCUMENTS

| | | | |
|---|---|---|---|
| JP | H06-251573 | A | 9/1994 |
| JP | H09-277678 | A | 10/1997 |
| JP | 2016-36906 | A | 3/2016 |

* cited by examiner

*Primary Examiner* — David H Banh
(74) *Attorney, Agent, or Firm* — Oliff PLC

(57) ABSTRACT

An opening/closing mechanism for an opening/closing cover includes the opening/closing cover, a cover protrusion, a protrusion engagement lever, an elastic member, and a cover opening section having an operation section, the cover opening section being configured to rotate the opening/closing cover in the closed position to a second position. The cover protrusion includes a second engaging portion configured to be pushed by the protrusion engagement member when the opening/closing cover is in the second position such that the opening/closing cover remains in the second position and includes a third engaging portion configured to be pushed by the protrusion engagement member when the opening/closing cover is in a third position between the second position and the open position such that the opening/closing cover rotates from the third position to the open position.

4 Claims, 13 Drawing Sheets

OPENING/CLOSING MECHANISM FOR OPENING/CLOSING COVER AND TAPE PRINTING DEVICE

The present application is based on, and claims priority from JP Application Serial Number 2021-043201, filed Mar. 17, 2021, the disclosure of which is hereby incorporated by reference herein in its entirety.

BACKGROUND

1. Technical Field

The present disclosure relates to an opening/closing mechanism for an opening/closing cover and to a tape printing device.

2. Related Art

An opening/closing mechanism for an opening/closing cover is disclosed in JP-A-2016-036906, which includes an opening/closing cover provided with a rib-shaped protrusion, an engagement lever that engages the rib-shaped protrusion, an urging spring that applies a force to the engagement lever in a direction in which the engagement lever rotates, and a cover-opening operation section that has an open button. Pressing the open button when the opening/closing cover is in a closed position causes a cover opening operation portion to rotate the opening/closing cover from the closed position to a predetermined partly open position. After the opening/closing cover is rotated to the predetermined position, the opening/closing cover is pushed to the open position by the rib-shaped protrusion and the engagement lever that has engaged the rib-shaped protrusion.

In the known opening/closing mechanism for the opening/closing cover, after the open button is pressed, the opening/closing cover is pushed to the open position by the engagement lever, causing the opening/closing cover to be rotated with excessive force to the open position. As a result, the opening/closing cover that has reached the open position may shudder momentarily. Accordingly, to reduce the force for rotating the opening/closing cover to the open position, the rib-shaped protrusion may be designed to interfere with the device case. However, in such a design in which the rib-shaped protrusion is configured to interfere with the device case, repetitive opening/closing of the opening/closing cover may cause the rib-shaped protrusion and/or the device case to wear or cause the device case to deform, reducing the effect of weakening the force applied to the opening/closing cover to rotate to the open position.

SUMMARY

According to an aspect of the present disclosure, an opening/closing mechanism for an opening/closing cover includes the opening/closing cover rotatable between a closed position and an open position, a cover protrusion provided to the opening/closing cover, a protrusion engagement member that is rotatably provided and configured to engage the cover protrusion, an elastic member configured to apply a force to the protrusion engagement member in a first rotation direction that is one rotation direction of the protrusion engagement member such that the cover protrusion is pushed by the protrusion engagement member in response to engagement of the cover protrusion by the protrusion engagement member, and a cover opening section having an operation section, the cover opening section being configured to rotate the opening/closing cover in the closed position to a second position between the closed position and the open position in response to an operation performed on the operation section. The cover protrusion includes a second engaging portion configured to be pushed by the protrusion engagement member when the opening/closing cover is in the second position such that the opening/closing cover remains in the second position, and a third engaging portion configured to be pushed by the protrusion engagement member when the opening/closing cover is in a third position between the second position and the open position such that the opening/closing cover rotates from the third position to the open position.

According to another aspect of the present disclosure, a tape printing device includes a thermal head configured to perform printing on a tape, a cartridge mounting section in which at least one of the tape and an ink ribbon is accommodated and a cartridge is to be mounted, an opening/closing cover rotatable between a closed position in which the cartridge mounting section is closed and an open position in which the cartridge mounting section is open, a cover protrusion provided to the opening/closing cover, a protrusion engagement member that is rotatably provided and configured to engage the cover protrusion, an elastic member configured to apply a force to the protrusion engagement member in a first rotation direction that is one rotating direction of the protrusion engagement member such that the cover protrusion is pushed by the protrusion engagement member in response to engagement of the cover protrusion by the protrusion engagement member, and a cover opening section having an operation section, the cover opening section being configured to rotate the opening/closing cover in the closed position to a second position between the closed position and the open position in response to an operation performed on the operation section. The cover protrusion includes a second engaging portion configured to be pushed by the protrusion engagement member when the opening/closing cover is in the second position such that the opening/closing cover remains in the second position, and a third engaging portion configured to be pushed by the protrusion engagement member when the opening/closing cover is in a third position between the second position and the open position such that the opening/closing cover rotates from the third position to the open position.

DESCRIPTION OF EXEMPLARY EMBODIMENTS

Figure 1:
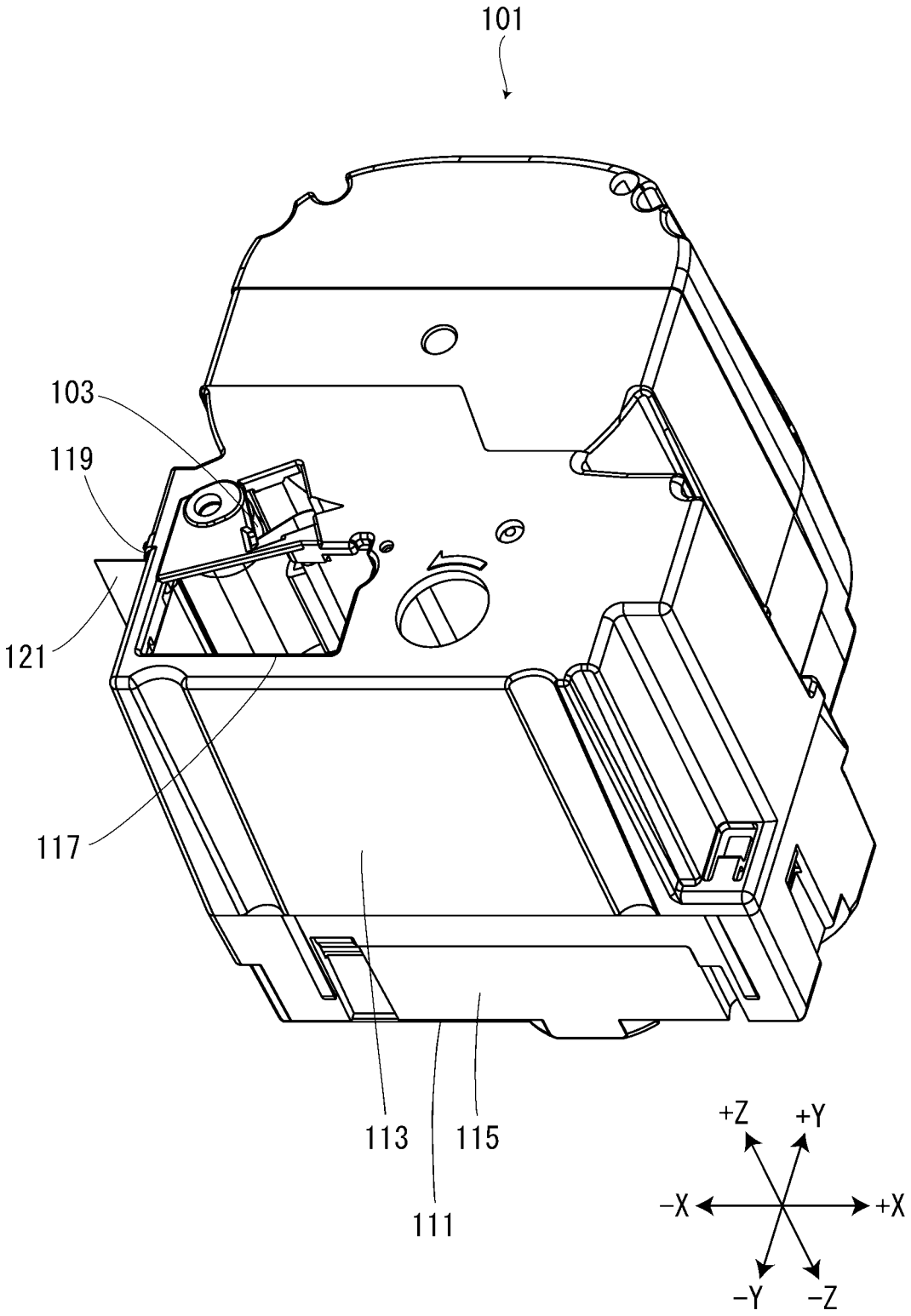
FIG. 1 is a perspective view illustrating a cartridge.

Hereinafter, a tape printing device 1 according to an embodiment of a tape printing device that includes an opening/closing mechanism for an opening/closing cover will be described with reference to the attached drawings. In the description below, the axes according to the XYZ orthogonal coordinate system are used in the drawings; however, these axes are merely for convenience and do not limit the following embodiments.

Cartridge

Figure 2:
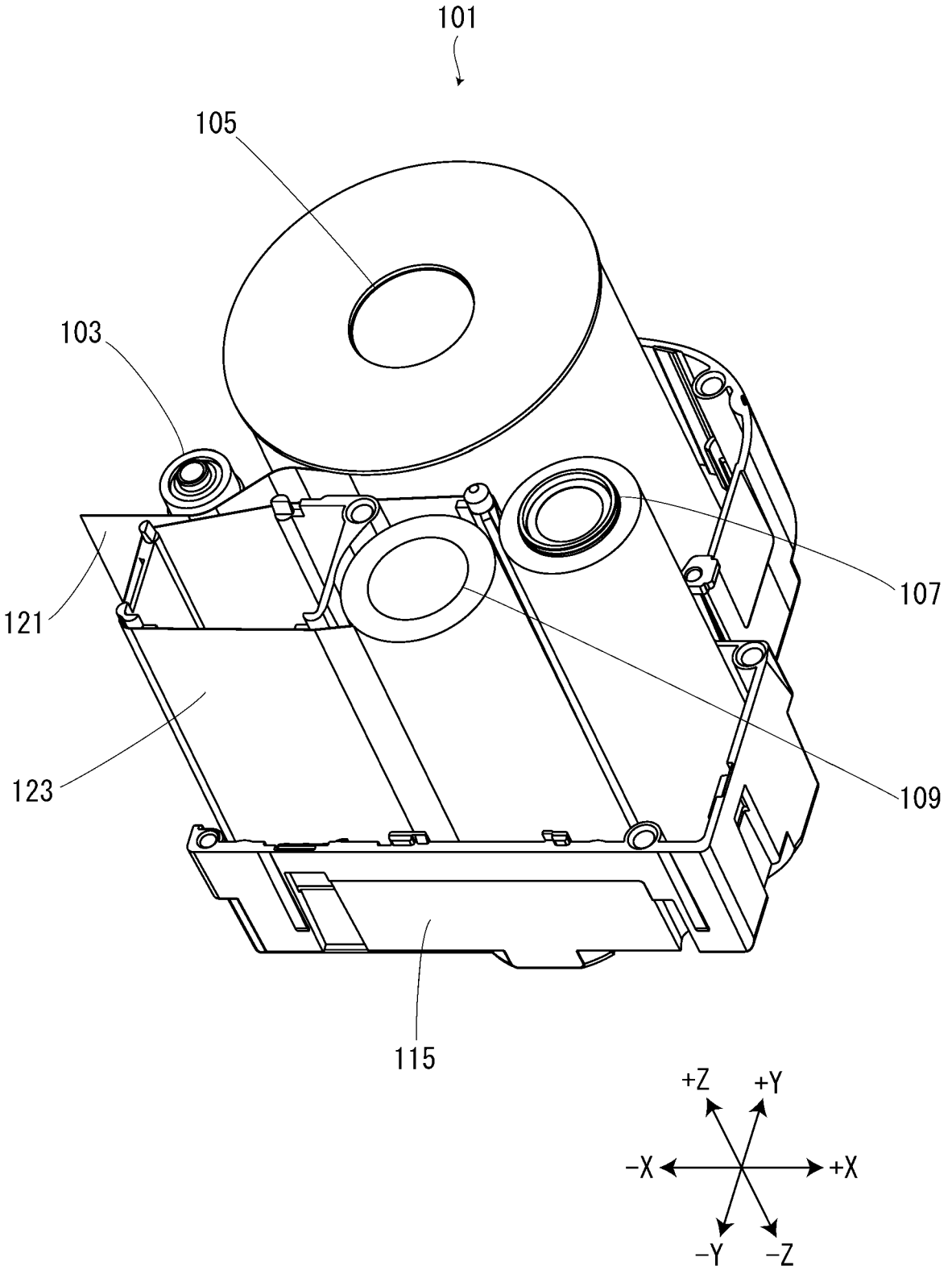
FIG. 2 is a perspective view illustrating a cartridge with a first case removed.

A cartridge 101 to be attached to the tape printing device 1 will be described with reference to FIG. 1 and FIG. 2. The cartridge 101 includes a platen roller 103, a tape core 105, a feeding core 107, a winding core 109, and a cartridge case 111 that houses these components.

The cartridge case 111 has a first case 113 and a second case 115. The second case 115 is provided in the negative Z direction with respect to the first case 113. The first case 113 and the second case 115 are detachably attached to each other. The cartridge case 111 has a head insertion hole 117 that extends in the Z axis. A tape feed slot 119 is provided in a wall portion of the cartridge case 111 in the negative X direction.

A tape 121 is wound around the tape core 105. The tape 121 is fed from the tape core 105 through the tape feed slot 119 to the outside of the cartridge case 111. An ink ribbon 123 is wound around the feeding core 107. The ink ribbon 123 fed from the feeding core 107 is wound by the winding core 109.

Tape Printing Device

Figure 3:
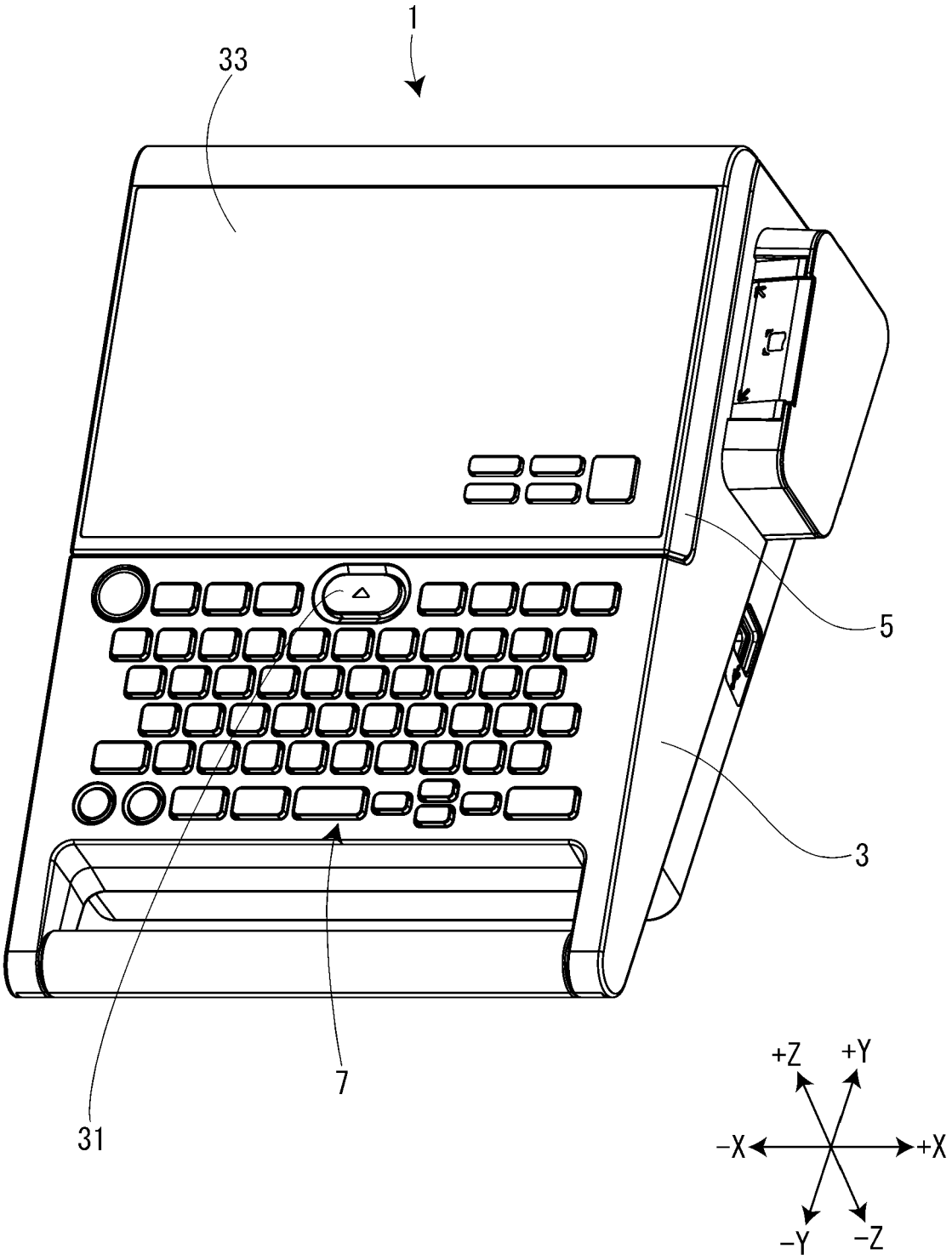
FIG. 3 is a perspective view illustrating a tape printing device with an opening/closing cover in a closed position.
Figure 4:
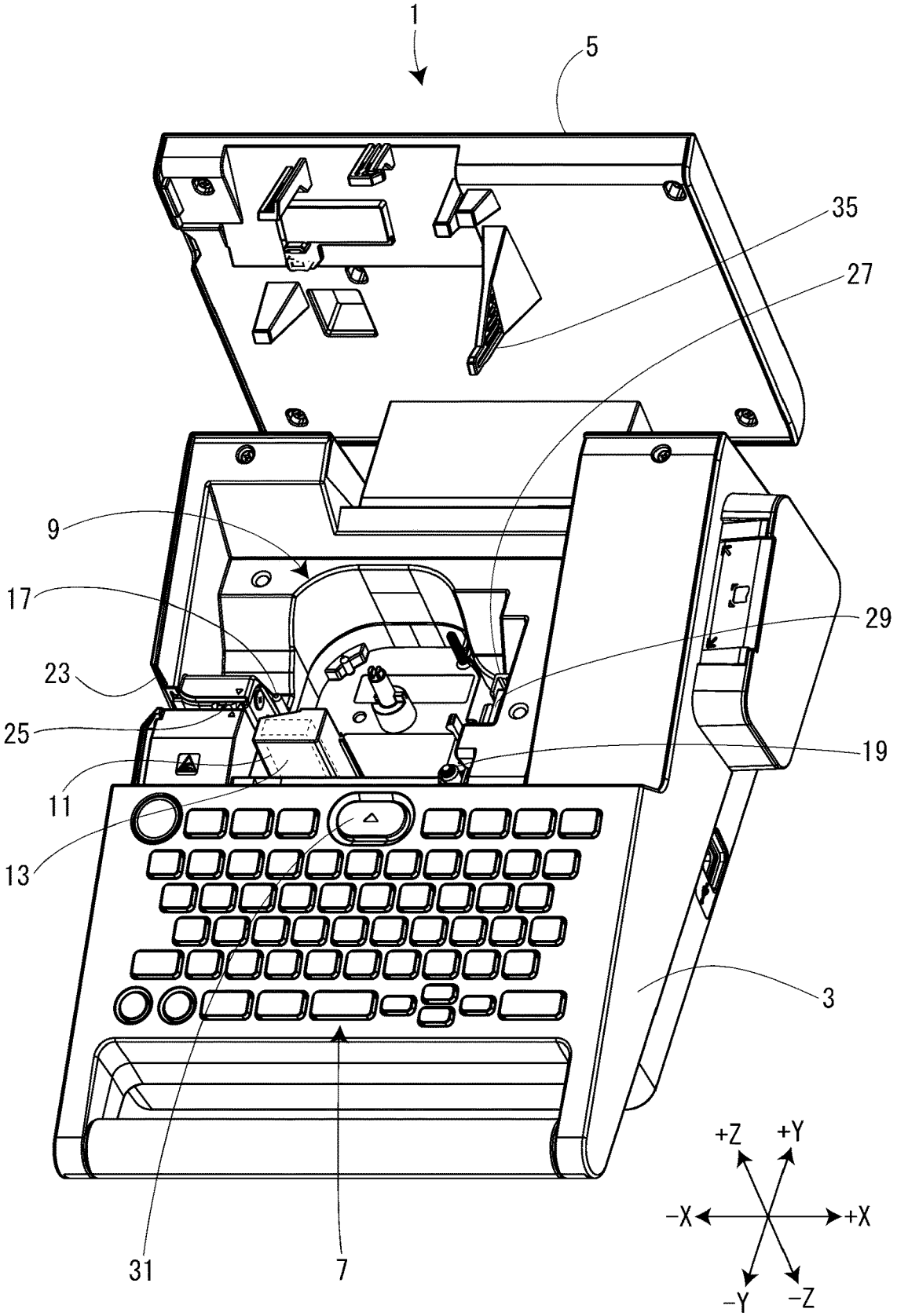
FIG. 4 is a perspective view illustrating a tape printing device with an opening/closing cover in an open position.

The tape printing device 1 has a device case 3 and an opening/closing cover 5 as illustrated in FIG. 3 and FIG. 4. A keyboard 7 and a cartridge mounting section 9 are provided on a side of the device case 3 in the positive Z direction.

The keyboard 7 receives a variety of operations input by users, such as operations for inputting characters to be printed.

The cartridge 101 is detachably attached to the cartridge mounting section 9. The cartridge mounting section 9 has a concave shape and its positive Z direction is open.

A thermal head 11 is disposed in the cartridge mounting section 9. The thermal head 11 is partially covered by a head cover 13, which protrudes from a bottom wall portion of the cartridge mounting section 9 in the positive Z direction. When the cartridge 101 is mounted in the cartridge mounting section 9, the thermal head 11 and the head cover 13 are inserted into the head insertion hole 117. The thermal head 11 is supported by a head support frame 15 illustrated in FIG. 5.

A platen shaft 17, a feeding shaft 19, and a winding shaft (not illustrated) are provided in the cartridge mounting section 9. When the cartridge 101 is mounted in the cartridge mounting section 9, the platen shaft 17, the feeding shaft 19, and the winding shaft are fitted into the platen roller 103, the feeding core 107, and the winding core 109, respectively. With this structure, the rotation of a feeding motor (not illustrated) is transmitted to the platen roller 103, the feeding core 107, and the winding core 109.

A tape exit slot 23 is provided in the device case 3 in the negative X direction. The tape 121 fed from the cartridge 101 mounted in the cartridge mounting section 9 is discharged from the tape exit slot 23.

A cutter 25 is disposed between the cartridge mounting section 9 and the tape exit slot 23. The cutter 25 is driven by a cutter motor (not illustrated) to cut the tape 121, and thereby a printed portion of the tape 121 is cut off. It should be noted that a single motor may be provided to function as the feeding motor and the cutter motor.

A protrusion advancing opening 27 is provided in an edge portion of the cartridge mounting section 9 in the positive X direction in the device case 3. A protrusion engagement lever 29 is disposed in the protrusion advancing opening 27.

The opening/closing cover 5 is rotatably attached to an end of the device case 3 in the positive Y direction and is used to open or close the cartridge mounting section 9. More specifically, the opening/closing cover 5 is rotatable between a closed position in which the cartridge mounting section 9 is closed as illustrated in FIG. 3 and an open position in which the cartridge mounting section 9 is open as illustrated in FIG. 4.

Figure 6:
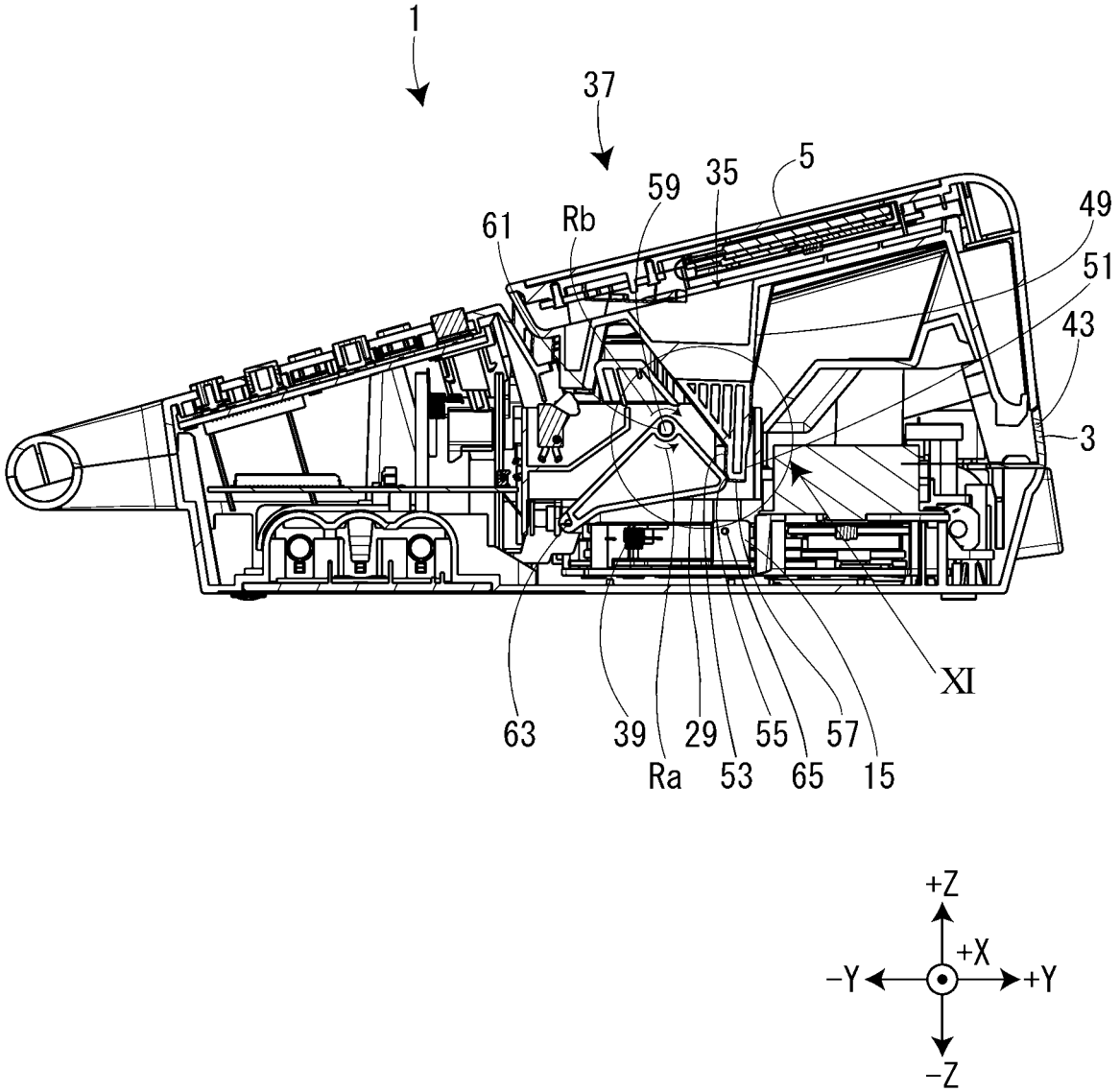
FIG. 6 is a cross-sectional view illustrating a tape printing device with an opening/closing cover in a second position viewed in a positive X direction.

A cover opening button 31 is disposed between the cartridge mounting section 9 and the keyboard 7. When the user presses the cover opening button 31 with the opening/closing cover 5 being in the closed position, the opening/closing cover 5 rotates to a second position, which will be described below, as illustrated in FIG. 6.

A display 33 is disposed on an outer surface of the opening/closing cover 5 and displays characters input via the keyboard 7 and a variety of information.

A cover protrusion 35 is disposed in a substantially central portion of an inner surface of the opening/closing cover 5. The cover protrusion 35 enters the protrusion advancing opening 27 in response to closing the opening/closing cover 5, that is, in response to the opening/closing cover 5 being rotated by the user from the open position to the closed position, and thereby the cover protrusion 35 engages the protrusion engagement lever 29, which is disposed in the protrusion advancing opening 27.

Figure 5:
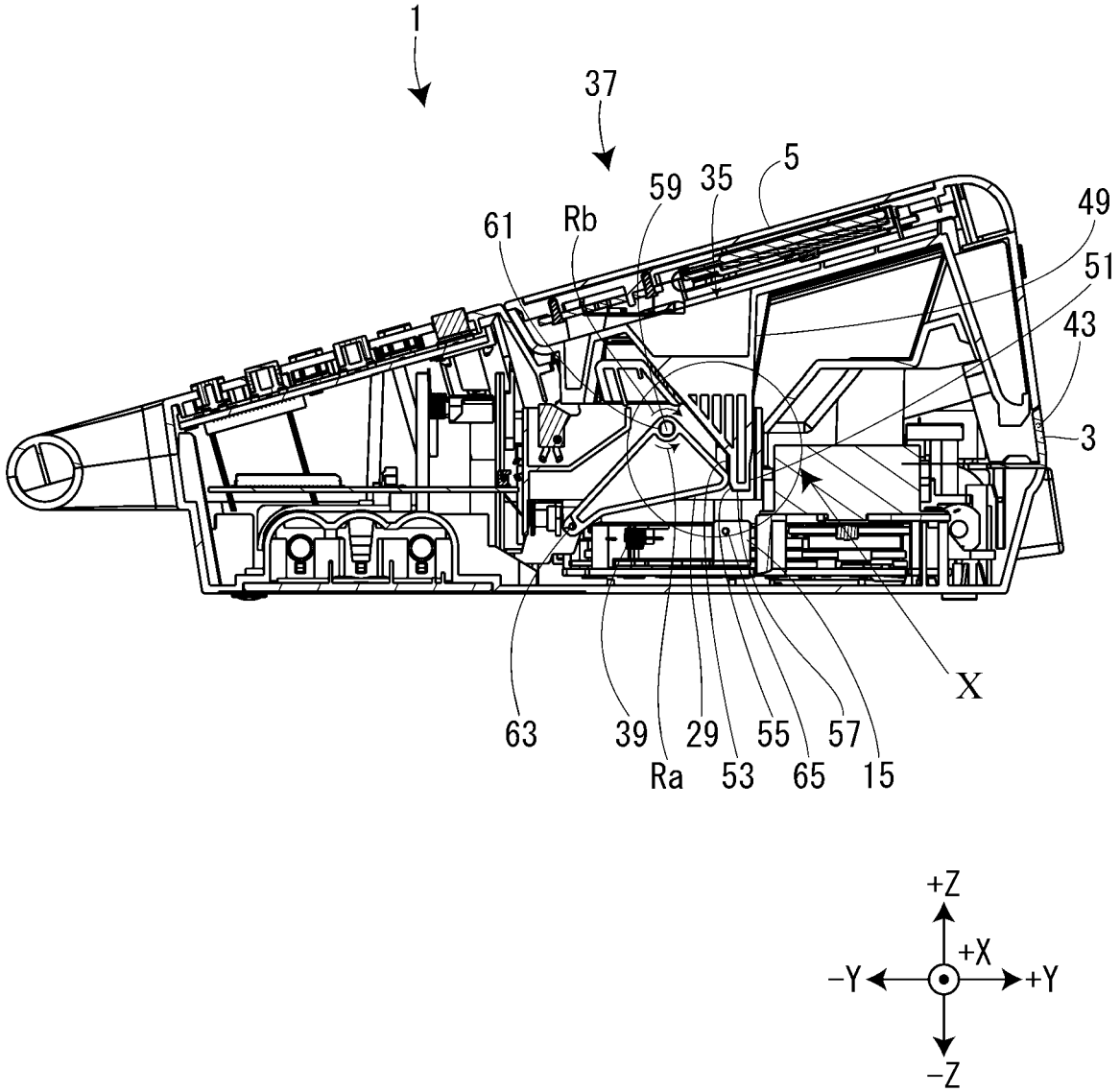
FIG. 5 is a cross-sectional view illustrating a tape printing device with an opening/closing cover in a closed position viewed in a positive X direction.

When the cartridge 101 is mounted in the cartridge mounting section 9 and the opening/closing cover 5 is closed, the cover protrusion 35 engages the protrusion engagement lever 29, causing the protrusion engagement lever 29 pushed by the cover protrusion 35 to rotate in a second rotation direction Rb illustrated in FIG. 5. This rotation causes the head support frame 15, which is coupled to the protrusion engagement lever 29 via a protrusion lever spring 39, which will be described below, to rotate around a head support shaft (not illustrated) to move the thermal head 11 toward the platen roller 103. As a result, the tape 121 and the ink ribbon 123 are nipped between the thermal head 11 and the platen roller 103. In this state, the tape printing device 1 performs print processing in accordance with print data generated in accordance with an input operation received via the keyboard 7. It should be noted that the tape printing device 1 may perform print processing in accordance with print data received from an external device such as a personal computer.

In print processing, the tape printing device 1 rotates the platen roller 103 and the winding core 109 by using the feeding motor and causes the thermal head 11 to generate heat. By the operation, the tape 121 is fed from the tape core 135 toward the tape exit slot 23 and the ink ribbon 123 is fed from the feeding core 107 toward the winding core 109, and thereby a print image corresponding to print data is printed on the tape 121. It should be noted that the tape printing device 1 may rotate the platen roller 103 in reverse by using the feed motor and rotate the feeding core 107 to rewind the tape 121 into the cartridge case 111 and also rewind the ink ribbon 123 onto the feeding core 107.

Cover Opening/Closing Mechanism

A cover opening/closing mechanism 37 provided in the tape printing device 1 will be described with reference to FIG. 5 to FIG. 12. The cover opening/closing mechanism 37 includes the opening/closing cover 5, the cover protrusion 35, the protrusion engagement lever 29, the protrusion lever spring 39, and a cover opening section 41.

Figure 7:
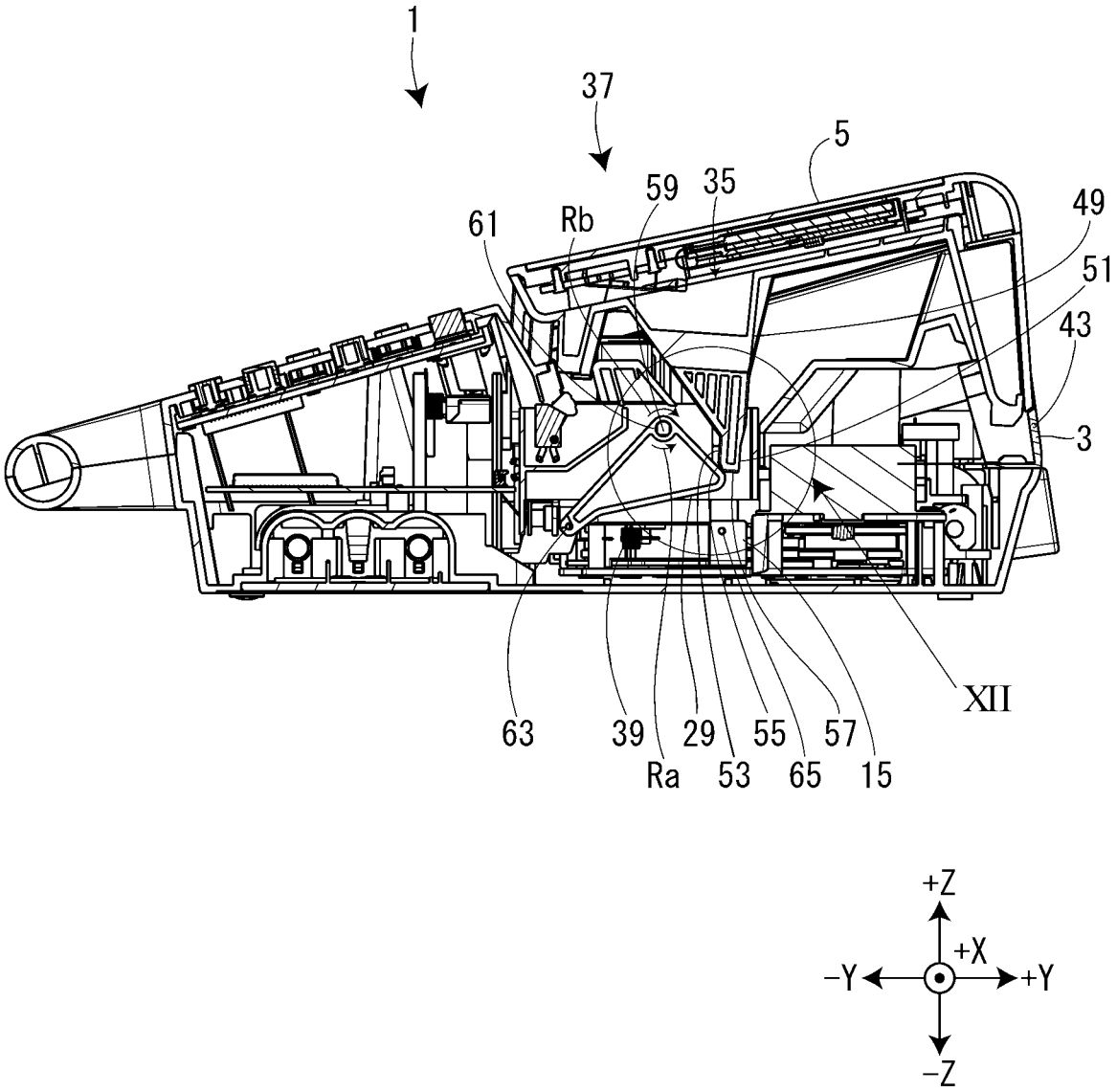
FIG. 7 is a cross-sectional view illustrating a tape printing device with an opening/closing cover in a third position viewed in a positive X direction.

As illustrated in FIG. 5 to FIG. 7, the opening/closing cover 5 has a substantially "L" shape when viewed in the positive X direction. The opening/closing cover 5 is attached in an openable manner to an end of the device case 3 in the positive Y direction via a hinge 43, which is disposed at an end of the opening/closing cover 5 in the positive Y direction and in the negative Z direction. An axis direction of the hinge 43 is substantially parallel to the X axis.

The cover protrusion 35 has a plate-like shape substantially parallel to the YZ plane and protrudes from the inner surface of the opening/closing cover 5. The cover protrusion 35 has a protrusion bottom portion 49 and a protrusion top portion 51. The protrusion bottom portion 49 has a substantially triangular plate-like shape and protrudes from the inner surface of the opening/closing cover 5 in the negative Z direction in a state in which the opening/closing cover is in the closed position illustrated in FIG. 5.

The protrusion top portion 51 has a substantially rectangular plate-like shape and protrudes in the negative Z direction from an end of the protrusion bottom portion 49 in the negative Z direction in a state in which the opening/closing cover is in the closed position illustrated in FIG. 5. The protrusion top portion 51 has a C chamfer plane at a corner between a surface in the negative Y direction and a surface in the negative Z direction. The protrusion top portion 51 includes a first engaging portion 53, a second engaging portion 55, and a third engaging portion 57. The first engaging portion 53 is the surface of the protrusion top portion 51 in the negative Y direction. The second engaging portion 55 is the C chamfer plane between the surface of the protrusion top portion 51 in the negative Y direction and the surface in the negative Z direction. The third engaging portion 57 is the surface of the protrusion top portion 51 in the negative Z direction. As will be described in detail below, when the opening/closing cover 5 is rotated from the closed position to the open position, the cover protrusion 35 engages the protrusion engagement lever 29 at the first engaging portion 53, the second engaging portion 55, and the third engaging portion 57 in this order.

The protrusion engagement lever 29 is rotatably supported by a lever support shaft 59. An axis direction of the lever support shaft 59 is substantially parallel to the X axis. A rotation direction of the protrusion engagement lever 29 has a first rotation direction Ra, which is the counterclockwise direction, and a second rotation direction Rb, which is the clockwise direction, when viewed in the positive X direction. The protrusion engagement lever 29 has a substantially triangular plate-like shape substantially parallel to the YZ plane. The protrusion engagement lever 29 engages the cover protrusion 35 in the vicinity of a corner of the protrusion engagement lever 29 in the positive Y direction. The protrusion engagement lever 29 has a lever shaft hole 61 and a lever-side spring engagement hole 63. The lever shaft hole 61 is provided in the vicinity of a corner of the protrusion engagement lever 29 in the positive Z direction. The lever support shaft 59 has been inserted into the lever shaft hole 61. The lever-side spring engagement hole 63 is provided in the vicinity of a corner of the protrusion engagement lever 29 in the negative Y direction. An end of the protrusion lever spring 39 in the negative Y direction engages the lever-side spring engagement hole 63.

The protrusion lever spring 39 couples the protrusion engagement lever 29 and the head support frame 15. More specifically, the end of the protrusion lever spring 39 in the negative Y direction engages the lever-side spring engagement hole 63, and the end of the protrusion lever spring 39 in the positive Y direction engages a frame-side spring engagement hole 65, which is provided in the head support frame 15. The protrusion lever spring 39 applies a force to the protrusion engagement lever 29 in the first rotation direction Ra. With this structure, when the cover protrusion 35 engages the protrusion engagement lever 29, the protrusion engagement lever 29 pushes the cover protrusion 35. In other words, the elastic force of the protrusion lever spring 39 is converted into a force for the protrusion engagement lever 29 to push the cover protrusion 35. The protrusion lever spring 39 may be, for example, a helical coil spring.

The protrusion lever spring 39 has a function of applying a force to the protrusion engagement lever 29 and a function of applying a force to the head support frame 15 to nip the tape 121 and the ink ribbon 123 with the thermal head 11 and the platen roller 103. The function of applying a force to the head support frame 15 may be implemented by an elastic member other than the protrusion lever spring 39. In other words, the end of the protrusion lever spring 39 in the positive Y direction may engage a member other than the head support frame 15.

Figure 8:
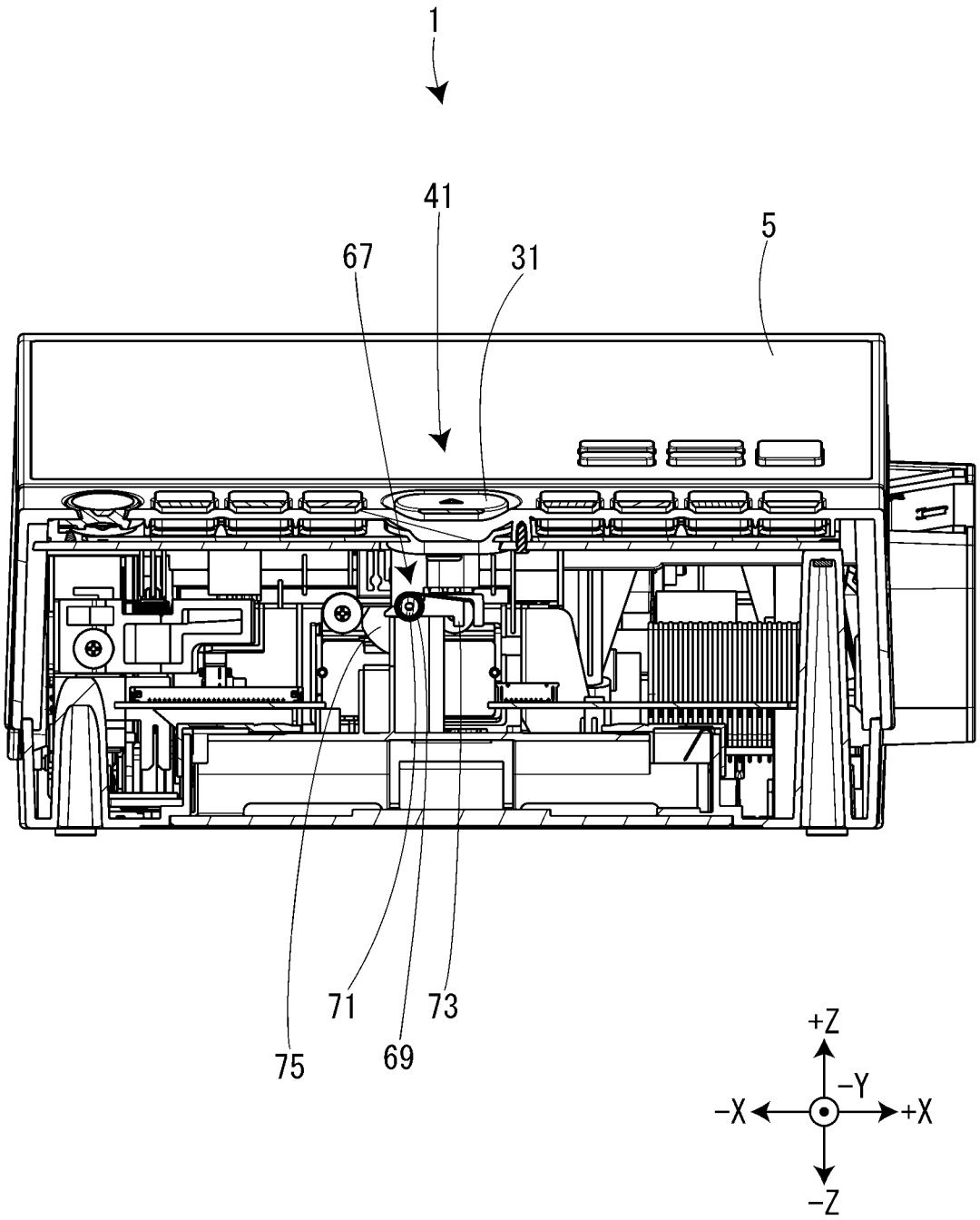
FIG. 8 is a cross-sectional view illustrating a tape printing device with an opening/closing cover in a closed position viewed in a negative Y direction.
Figure 9:
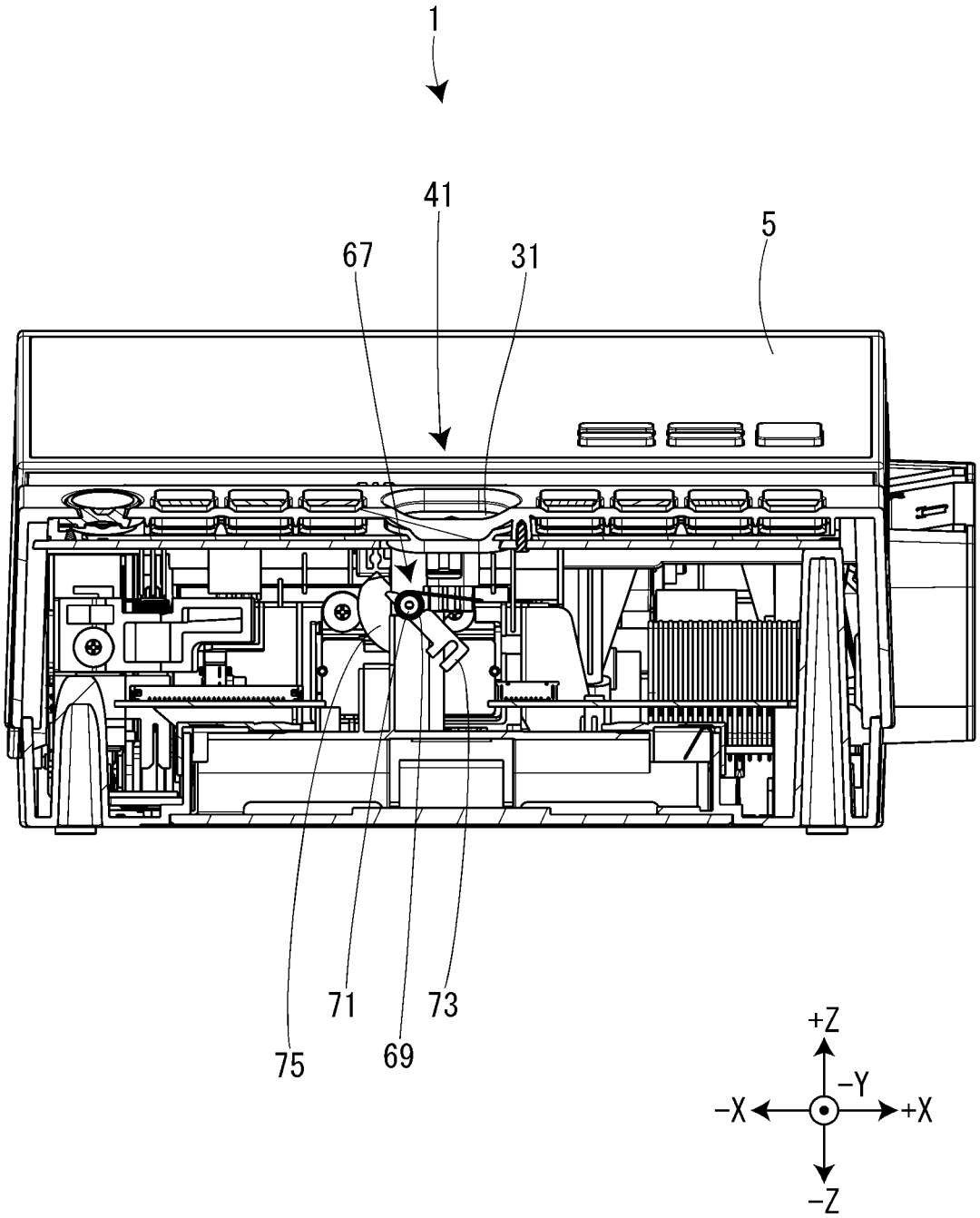
FIG. 9 is a cross-sectional view illustrating a tape printing device with an opening/closing cover in a second position viewed in a negative Y direction.

The cover opening section 41 includes, in addition to the above-described cover opening button 31, a button engagement lever 67 and a button lever spring 69 as illustrated in FIG. 8 and FIG. 9. The button engagement lever 67 includes a lever shaft section 71, a button receiving section 73, and a cover pressing section 75. An axis direction of the lever shaft section 71 is substantially parallel to the Y axis. The button engagement lever 67 is rotatable around the lever shaft section 71. The button receiving section 73 is disposed in the positive X direction with respect to the lever shaft section 71. The cover pressing section 75 is disposed in the negative X direction with respect to the lever shaft section 71. The button lever spring 69 applies a force to the button engagement lever 67 in the counterclockwise direction when viewed in the negative Y direction. The button lever spring 69 may be, for example, a helical torsion spring.

As illustrated in FIG. 9, the cover opening button 31 pressed in the negative Z direction presses the button receiving section 73 in the negative Z direction. This operation causes the button engagement lever 67 to rotate in the clockwise direction against the button lever spring 69 when viewed in the negative Y direction, causing the cover pressing section 75 to press the opening/closing cover 5 in the positive Z direction. As a result, the opening/closing cover 5 rotates from the closed position to the second position between the closed position and the open position.

Next, a force applied to the cover protrusion 35 by the protrusion engagement lever 29 when the cover protrusion 35 engages the protrusion engagement lever 29 will be described. In the description below, an opening direction denotes a direction in which the opening/closing cover 5 is moved to the open position and a closing direction denotes a direction opposite to the opening direction. The opening direction and the closing direction are orthogonal to a virtual line extending from an engagement position between the cover protrusion 35 and the protrusion engagement lever 29 to the hinge 43, about which the opening/closing cover 5 rotates, when viewed in the positive X direction.

Figure 10:
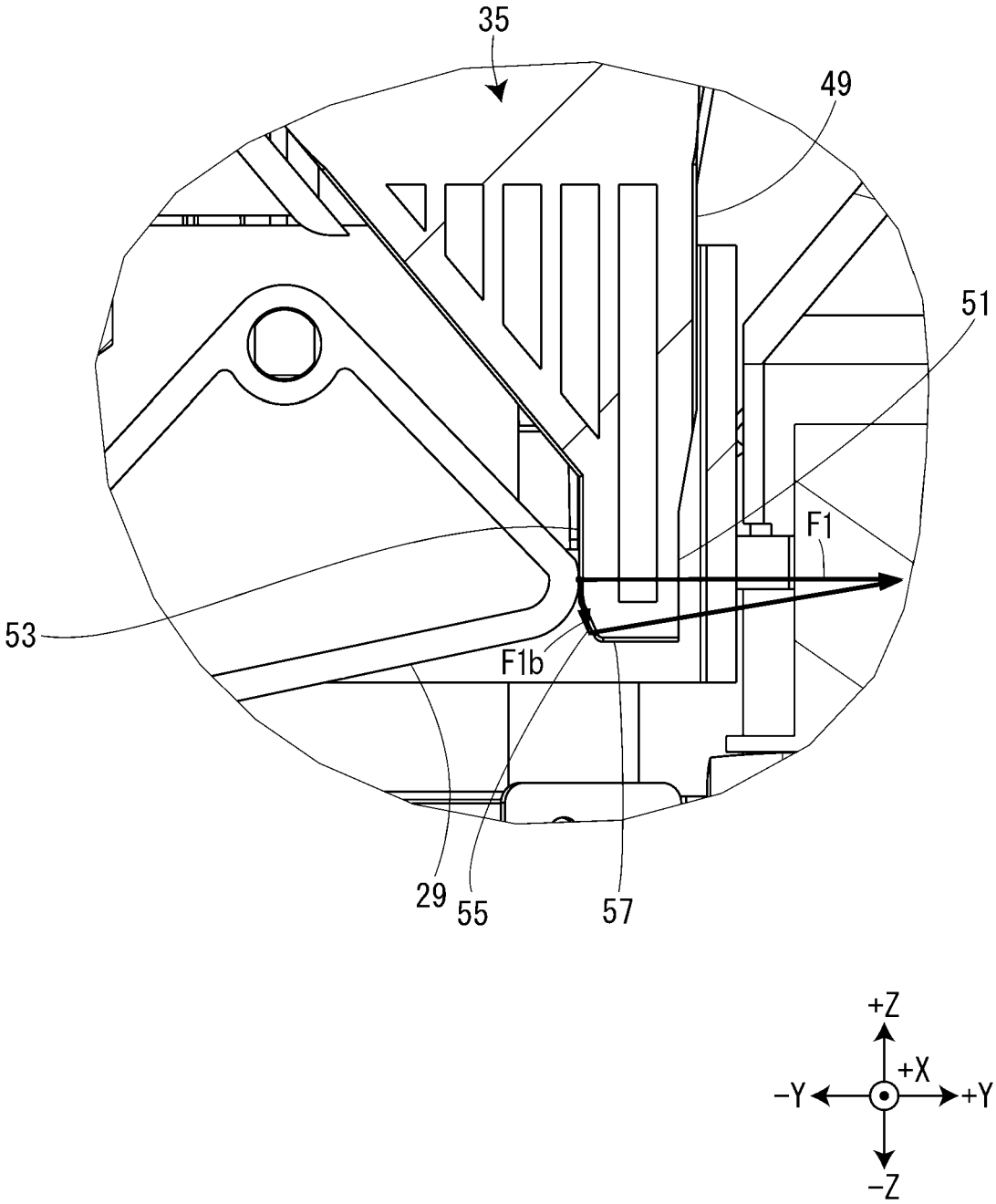
FIG. 10 is an enlarged view illustrating a portion circled by line X in FIG. 5.

As illustrated in FIG. 5, when the opening/closing cover 5 is in the closed position, the first engaging portion 53 is pushed by the protrusion engagement lever 29. In this state, the force applied by the protrusion engagement lever 29 to push the first engaging portion 53 as illustrated in FIG. 10 is referred to as a first pushing force F1. The first pushing force F1 has a first closing component F1*b* that is a component in the closing direction. With this structure, when the opening/closing cover 5 is in the closed position, the first engaging portion 53 is pushed by the protrusion engagement lever 29 to suppress the opening/closing cover 5 from rotating from the closed position to the open position. Accordingly, when the opening/closing cover 5 is in the closed position, the opening/closing cover 5 can be suppressed from being loosely closed.

Figure 11:
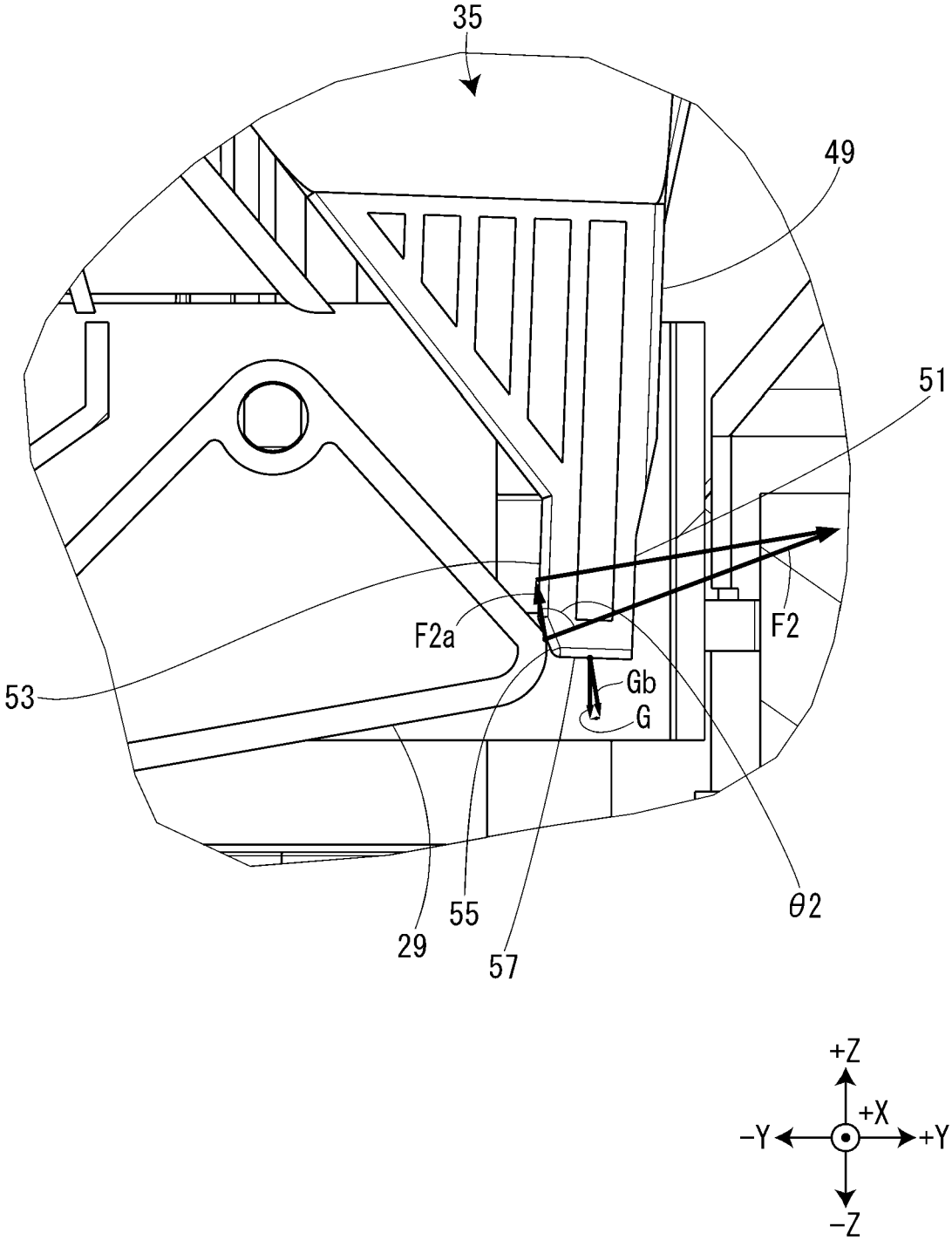
FIG. 11 is an enlarged view illustrating a portion circled by line XI in FIG. 6.

As illustrated in FIG. 6, when the opening/closing cover 5 is in the second position, the second engaging portion 55 is pushed by the protrusion engagement lever 29. In this state, the force applied by the protrusion engagement lever 29 to push the second engaging portion 55 as illustrated in FIG. 11 is referred to as a second pushing force F2, and an angle between a direction of the second pushing force F2 and the opening direction is referred to as a second angle θ2. The second angle θ2 is greater than a third angle θ3, which will be described below. In this structure, the second pushing force F2 has a second opening component F2*a* that is a component in the opening direction. The second opening component F2*a* is less than a third opening component F3*a*, which will be described below, and equal to or less than a gravity closing component Gb. Accordingly, when the opening/closing cover 5 is in the second position, the second engaging portion 55 is pushed by the protrusion engagement lever 29 such that the opening/closing cover 5 remains in the second position.

Figure 12:
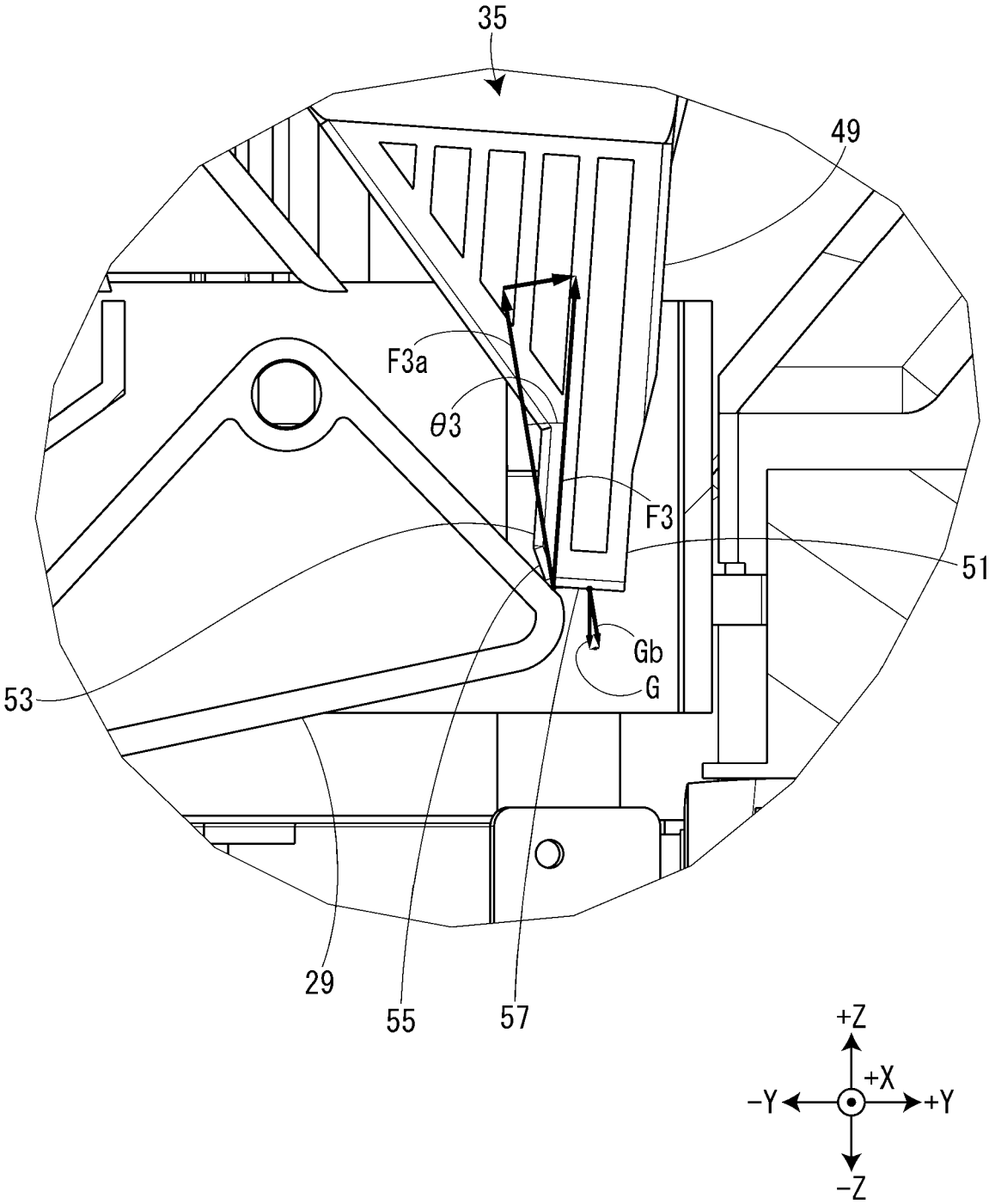
FIG. 12 is an enlarged view illustrating a portion circled by line XII in FIG. 7.

As illustrated in FIG. 7, when the opening/closing cover 5 is in a third position, which is between the second position and the open position, the third engaging portion 57 is pushed by the protrusion engagement lever 29. In this state, the force applied by the protrusion engagement lever 29 to push the third engaging portion 57 as illustrated in FIG. 12 is referred to as a third pushing force F3, and an angle between a direction of the third pushing force F3 and the opening direction is referred to as a third angle θ3. The third pushing force F3 has a third opening component F3*a* that is a component in the opening direction. The third opening component F3*a* is greater than the gravity closing component Gb, which is a component of the gravity G in the closing direction exerted on the opening/closing cover 5. Accordingly, when the opening/closing cover 5 is in the third position, the third engaging portion 57 is pushed by the protrusion engagement lever 29 such that the opening/closing cover 5 rotates from the third position to the open position.

Unlike the structure according to the embodiment, in a structure in which the cover protrusion 35 does not have the second engaging portion 55 and the opening/closing cover 5 is rotated from the closed position to the third position by the cover opening section 41 when the cover opening button 31 is pressed in a state in which the opening/closing cover 5 is in the closed position, when the opening/closing cover 5 is rotated to the third position, the third engaging portion 57 is pushed by the protrusion engagement lever 29 such that the opening/closing cover 5 rotates from the third position to the open position. Accordingly, in response to the cover opening button 31 being pressed, the opening/closing cover 5 rotates with excessive force to the open position, and after the opening/closing cover 5 reaches the open position, the opening/closing cover 5 may shudder momentarily. However, to weaken the force for rotating the opening/closing cover 5 to the open position, if the cover protrusion 35 is configured to interfere with the device case 3 such that the cover protrusion 35 is slid with respect to the device case 3, that is, with respect to the end of the protrusion advancing opening 27, repetitive opening/closing of the opening/closing cover 5 may cause the cover protrusion 35 and/or the device case 3 to wear or cause the device case 3 to deform, reducing the effect of weakening the force for rotating the opening/closing cover 5 to the open position.

In contrast, according to the embodiment, the cover protrusion 35 has the second engaging portion 55 and when the cover opening button 31 is pressed in a state in which the opening/closing cover 5 is in the closed position, the opening/closing cover 5 is rotated from the closed position to the second position by the cover opening section 41. When the opening/closing cover 5 is rotated to the second position, the second engaging portion 55 is pushed by the protrusion engagement lever 29 such that the opening/closing cover 5 remains in the second position. With this structure, after the cover opening button 31 is pressed, the opening/closing cover 5 remains in the second position, that is, the opening/closing cover 5 is in a half-open state. Accordingly, the opening/closing cover 5 is suppressed from rotating to the open position with excessive force in response to the cover opening button 31 being pressed.

After pressing the cover opening button 31, the user holds the opening/closing cover 5 that remains in the second position and rotates the opening/closing cover 5 to the open position. While the opening/closing cover 5 rotates from the second position to the open position, the opening/closing cover 5 passes the third position. During the rotation, the third engaging portion 57 is pushed by the protrusion engagement lever 29 such that the opening/closing cover 5 rotates from the third position to the open position. With this structure, the protrusion engagement lever 29 that has engaged the third engaging portion 57 pushes the opening/closing cover 5 to the open position. Accordingly, the user can smoothly rotate the opening/closing cover 5 from the third position to the open position.

As described above, in the cover opening/closing mechanism 37 according to the embodiment, when the cover opening button 31 is pressed and the opening/closing cover 5 is rotated from the closed position to the second position, the second engaging portion 55 is pushed by the protrusion engagement lever 29 such that the opening/closing cover 5 remains in the second position. With this structure, the opening/closing cover 5 remains in the second position without rotating from the second position to the open position. Accordingly, even though the opening/closing cover 5 is repeatedly opened or closed, unlike a structure in which the cover protrusion 35 is configured to interfere with the device case 3, the opening/closing cover 5 is suppressed from rotating to the open position with excessive force in response to the cover opening button 31 being pressed. As a result, the opening/closing cover 5 is suppressed from shuddering momentarily after the opening/closing cover 5 has reached the open position.

Other Modifications

It is to be understood that the present disclosure is not limited to the above-described embodiment, and various modifications may be made without departing from the scope of the disclosure. For example, in addition to the above-described embodiment, the embodiment may be modified as described below. Furthermore, the above-described embodiment and its modifications may be combined with each other.

Figure 13:
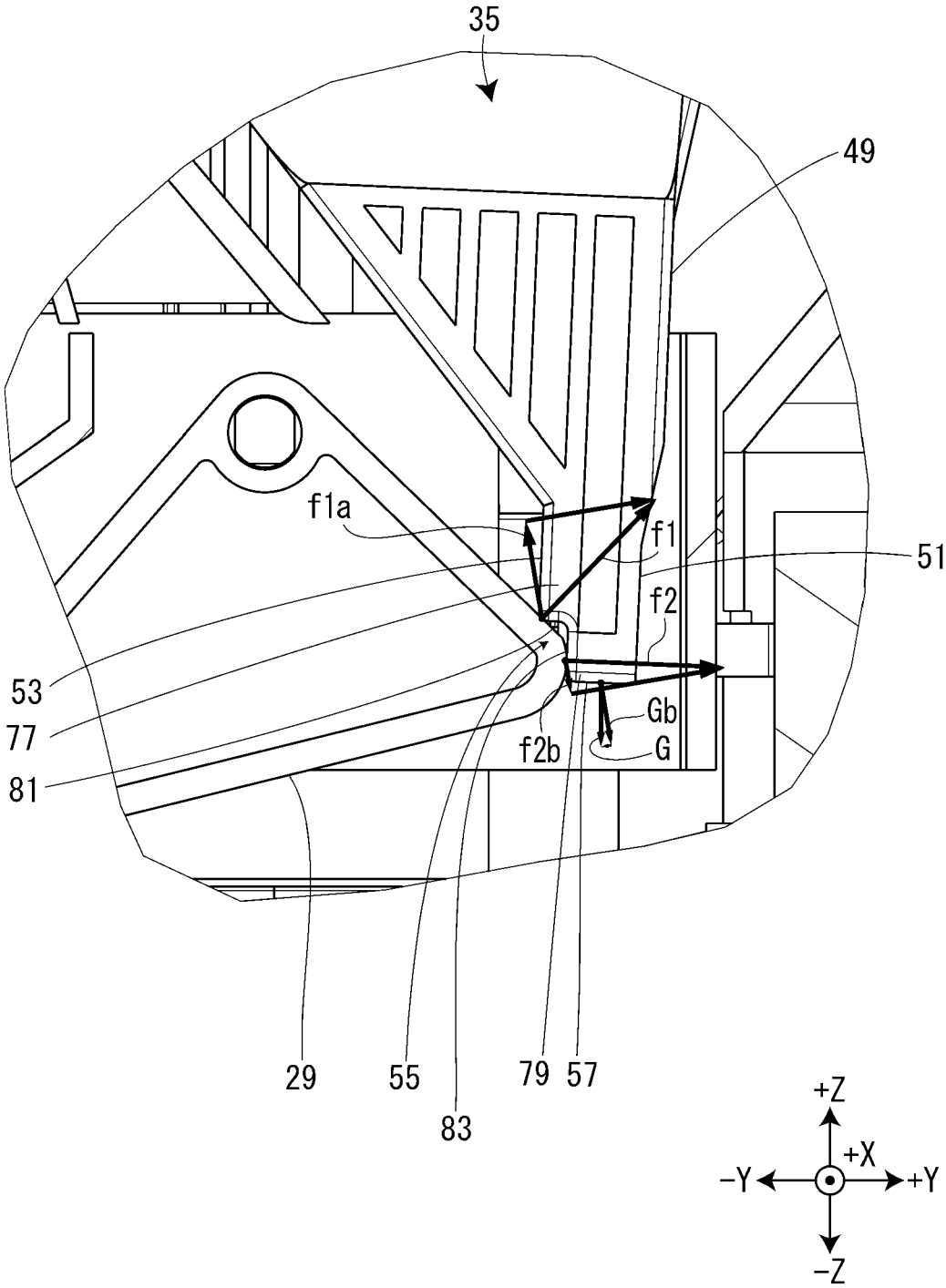
FIG. 13 is a view illustrating a cover protrusion according to a modification.

FIG. 13 is a view illustrating a modification of the cover protrusion 35. The cover protrusion 35 according to the modification has a first convex portion 77 and a second convex portion 79 that are formed in stepped shapes at a corner between the surface of the protrusion top portion 51 in the negative Y direction and the surface in the negative Z direction, instead of the C chamfer plane. The second convex portion 79 is located in the positive Y direction and in the negative Z direction with respect to the first convex portion 77. The second engaging portion 55 of the cover protrusion 35 according to the modification has a first portion engaging portion 81 that is a surface of the first convex portion 77 in the negative Z direction and a second portion engaging portion 83 that is a surface of the second convex portion 79 in the negative Y direction.

When the opening/closing cover 5 is in the second position, the first portion engaging portion 81 and the second portion engaging portion 83 of the second engaging portion 55 are pushed by the protrusion engagement lever 29. In this state, the force applied by the protrusion engagement lever 29 to push the first portion engaging portion 81 is referred to as a first portion pushing force f1, and the force applied by the protrusion engagement lever 29 to push the second portion engaging portion 83 is referred to as a second portion pushing force f2. The first portion pushing force f1 has a first opening component f1*a* that is a component in the opening direction. Accordingly, the first portion engaging portion 81 is pushed by the protrusion engagement lever 29 such that the opening/closing cover 5 rotates from the second position to the open position. In contrast, the second portion pushing force f2 has a second closing component 12*b* that is a component in the closing direction. Accordingly, the second portion engaging portion 83 is pushed by the protrusion engagement lever 29 such that the opening/closing cover 5 rotates from the second position to the closed position. In this structure, the resultant of the first portion opening component f1*a* and the second portion closing component f2*b* is equal to or less than the gravity closing component Gb.

With this structure, in the second engaging portion 55, the first portion engaging portion 81 is pushed such that the opening/closing cover 5 rotates to the open position and the second portion engaging portion 83 is pushed such that the opening/closing cover 5 rotates to the closed position, which is opposite to the open position. As a result, also in the structure having the cover protrusion 35 according to the modification when the opening/closing cover 5 is in the second position, the second engaging portion 55 is pushed by the protrusion engagement lever 29 such that the opening/closing cover 5 remains in the second position.

It should be noted that the operation section is not limited to the structure that is pressed by a user, such as the cover opening button 31, and the operation section may be, for example, a structure that is slid or pulled by a user. The cover opening/closing mechanism 37 may include a drive source such as a motor that rotates the opening/closing cover 5 from the closed position to the second position.

The cartridge 101 is not limited to the structure that accommodates the tape 121 and the ink ribbon 123 and may be a structure that accommodates the tape 121 or the ink ribbon 123. For example, a structure may be provided in which printing is performed by using the tape 121 that is thermal paper accommodated in the cartridge 101 and by using the thermal head 11 without using the ink ribbon 123. In another example, a structure may be provided in which printing is performed on the tape 121 by using the tape 121 that is provided from outside the tape printing device 1, the ink ribbon 123 accommodated in the cartridge 101, and the thermal head 11.

The cover opening/closing mechanism 37 may be applied not only to the opening/closing cover 5, which opens or closes the cartridge mounting section 9 in which the cartridge 101 is mounted, but also to other opening/closing covers. For example, the cover opening/closing mechanism 37 may be applied to an opening/closing cover that opens or closes the ink cartridge mounting section in which the ink cartridge is mounted or to an opening/closing cover that opens or closes a battery mounting section in which a battery is mounted.

Supplementary Notes

Hereinafter, supplementary notes of the opening/closing mechanism for the opening closing cover and the tape printing device will be provided. An opening/closing mechanism for an opening/closing cover includes the opening/closing cover rotatable between a closed position and an open position, a cover protrusion provided to the opening/closing cover, a protrusion engagement member that is rotatably provided and configured to engage the cover protrusion, an elastic member configured to apply a force to the protrusion engagement member in a first rotation direction that is one rotation direction of the protrusion engagement member such that the cover protrusion is pushed by the protrusion engagement member in response to engagement of the cover protrusion by the protrusion engagement member, and a cover opening section having an operation section, the cover opening section being configured to rotate the opening/closing cover in the closed position to a second position between the closed position and the open position in response to an operation performed on the operation section. The cover protrusion includes a second engaging portion configured to be pushed by the protrusion engagement member when the opening/closing cover is in the second position such that the opening/closing cover remains in the second position, and a third engaging portion configured to be pushed by the protrusion engagement member when the opening/closing cover is in a third position between the second position and the open position such that the opening/closing cover rotates from the third position to the open position.

With this structure, when the operation section is operated and the opening/closing cover is rotated from the closed position to the second position, the second engaging portion is pushed by the protrusion engagement member such that the opening/closing cover remains in the second position, causing the opening/closing cover to remain in the second position without rotating from the second position to the open position. Accordingly, even though the opening/closing cover is repeatedly opened or closed, the opening/closing cover is suppressed from rotating to the open position with excessive force in response to the operating section being pressed, unlike a structure in which the cover protrusion is configured to interfere with a device case. Note that the protrusion engagement lever 29 is an example of the "protrusion engagement member", the cover opening button 31 is an example of the "operation section", the cover opening/closing mechanism 37 is an example of the "opening/closing mechanism for an opening/closing cover", and the protrusion lever spring 39 is an example of the "elastic member".

In such a case, a second angle between a direction of a second pushing force applied by the protrusion engagement member to push the second engaging portion and an opening direction in which the opening/closing cover is moved to the open position may be greater than a third angle between a direction of a third pushing force applied by the protrusion engagement member to push the third engaging portion and the opening direction.

With this structure, a second opening component that is a component of the second pushing force in the opening direction is less than a third opening component that is a component of the third pushing force in the opening direction. Accordingly, when the opening/closing cover is in the second position, the second engaging portion is pushed by the protrusion engagement lever such that the opening/closing cover remains in the second position.

In such a case, the second engaging portion may include a first portion engaging portion configured to be pushed by the protrusion engagement member when the opening/closing cover is in the second position such that the opening/closing cover rotates from the second position to the open position, and include a second portion engaging portion configured to be pushed by the protrusion engagement member when the opening/closing cover is in the second position such that the opening/closing cover rotates from the second position to the closed position.

With this structure, in the second engaging portion, the first portion engaging portion is pushed such that the opening/closing cover rotates to the open position, and the second portion engaging portion is pushed such that the opening/closing cover rotates to the closed position, which is opposite to the open position. Accordingly, when the opening/closing cover is in the second position, the second engaging portion is pushed by the protrusion engagement lever such that the opening/closing cover remains in the second position.

In such a case, the cover protrusion may include a first engaging portion configured to be pushed by the protrusion engagement member when the opening/closing cover is in the closed position such that the opening/closing cover is suppressed from rotating from the closed position to the open position.

With this structure, when the opening/closing cover is in the closed position, the opening/closing cover can be suppressed from being loosely closed.

A tape printing device includes a thermal head configured to perform printing on a tape, a cartridge mounting section in which at least one of the tape and an ink ribbon is accommodated and a cartridge is to be mounted, an opening/closing cover rotatable between a closed position in which the cartridge mounting section is closed and an open position in which the cartridge mounting section is open, a cover protrusion provided to the opening/closing cover, a protrusion engagement member that is rotatably provided and configured to engage the cover protrusion, an elastic member configured to apply a force to the protrusion engagement member in a first rotation direction that is one rotating direction of the protrusion engagement member such that the cover protrusion is pushed by the protrusion engagement member in response to engagement of the cover protrusion by the protrusion engagement member, and a cover opening section having an operation section, the cover opening section being configured to rotate the opening/closing cover in the closed position to a second position between the closed position and the open position in response to an operation performed on the operation section. The cover protrusion includes a second engaging portion configured to be pushed by the protrusion engagement member when the opening/closing cover is in the second position such that the opening/closing cover remains in the second position, and a third engaging portion configured to be pushed by the protrusion engagement member when the opening/closing cover is in a third position between the second position and the open position such that the opening/closing cover rotates from the third position to the open position.

With this structure, when the operation section is pressed and the opening/closing cover is rotated from the closed position to the second position, the second engaging portion is pushed by the protrusion engagement member such that the opening/closing cover remains in the second position, causing the opening/closing cover to remain in the second position without rotating from the second position to the open position. Accordingly, even though the opening/closing cover is repeatedly opened or closed, the opening/closing cover is suppressed from rotating to the open position with excessive force in response to the operating section being pressed, unlike a structure in which the cover protrusion is configured to interfere with a device case.

What is claimed is:

1. An opening/closing mechanism for an opening/closing cover comprising:

the opening/closing cover rotatable between a closed position and an open position;

a cover protrusion provided to the opening/closing cover;

a protrusion engagement member that is rotatably provided and configured to engage the cover protrusion;

an elastic member configured to apply a force to the protrusion engagement member in a first rotation direction that is one rotation direction of the protrusion engagement member such that the cover protrusion is pushed by the protrusion engagement member in response to engagement of the cover protrusion by the protrusion engagement member; and a cover opening section having an operation section, the cover opening section being configured to rotate the opening/closing cover in the closed position to a second position between the closed position and the open position in response to an operation performed on the operation section, wherein the cover protrusion includes a second engaging portion configured to be pushed by the protrusion engagement member when the opening/closing cover is in the second position such that the opening/closing cover remains in the second position, and a third engaging portion configured to be pushed by the protrusion engagement member when the opening/closing cover is in a third position between the second position and the open position such that the opening/closing cover rotates from the third position to the open position, the cover protrusion includes a first engaging portion configured to be pushed by the protrusion engagement member when the opening/closing cover is in the closed position such that the opening/closing cover is suppressed from rotating from the closed position to the open position, and the first engaging portion has a surface that is above a surface of the second engaging portion in the opening direction, the surface of the first engaging portion being perpendicular to the surface of the second engaging portion.

2. The opening/closing mechanism for the opening/closing cover according to claim 1, wherein a second angle between a direction of a second pushing force applied by the protrusion engagement member to push the second engaging portion and an opening direction in which the opening/closing cover is moved to the open position is greater than a third angle between a direction of a third pushing force applied by the protrusion engagement member to push the third engaging portion and the opening direction.

3. The opening/closing mechanism for the opening/closing cover according to claim 1, wherein the second engaging portion includes a first portion engaging portion configured to be pushed by the protrusion engagement member when the opening/closing cover is in the second position such that the opening/closing cover rotates from the second position to the open position, and a second portion engaging portion configured to be pushed by the protrusion engagement member when the opening/closing cover is in the second position such that the opening/closing cover rotates from the second position to the closed position.

4. A tape printing device comprising:

a thermal head configured to perform printing on a tape;

a cartridge mounting section in which at least one of the tape and an ink ribbon is accommodated and a cartridge is to be mounted;

an opening/closing cover rotatable between a closed position in which the cartridge mounting section is closed and an open position in which the cartridge mounting section is open;

a cover protrusion provided to the opening/closing cover;

a protrusion engagement member that is rotatably provided and configured to engage the cover protrusion;

an elastic member configured to apply a force to the protrusion engagement member in a first rotation direction that is one rotating direction of the protrusion engagement member such that the cover protrusion is pushed by the protrusion engagement member in response to engagement of the cover protrusion by the protrusion engagement member; and a cover opening section having an operation section, the cover opening section being configured to rotate the opening/closing cover in the closed position to a second position between the closed position and the open position in response to an operation performed on the operation section, wherein the cover protrusion includes a second engaging portion configured to be pushed by the protrusion engagement member when the opening/closing cover is in the second position such that the opening/closing cover remains in the second position, and a third engaging portion configured to be pushed by the protrusion engagement member when the opening/closing cover is in a third position between the second position and the open position such that the opening/closing cover rotates from the third position to the open position, the cover protrusion includes a first engaging portion configured to be pushed by the protrusion engagement member when the opening/closing cover is in the closed position such that the opening/closing cover is suppressed from rotating from the closed position to the open position, and the first engaging portion has a surface that is above a surface of the second engaging portion in the opening direction, the surface of the first engaging portion being perpendicular to the surface of the second engaging portion.

* * * * *